US008047259B2

(12) United States Patent
Long et al.

(10) Patent No.: US 8,047,259 B2
(45) Date of Patent: Nov. 1, 2011

(54) HIGH TEMPERATURE METAL MOLD AND PROCEDURE FOR MAKING THE MOLD

(75) Inventors: Li Long, Shenzhen (CN); De-Bao Ma, Shenzhen (CN); Chao-Hsun Lin, Taipei (TW); Da-Wei Ding, Shenzhen (CN); Yong-Gang Zhu, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 40 days.

(21) Appl. No.: 12/694,414

(22) Filed: Jan. 27, 2010

(65) Prior Publication Data

US 2011/0036967 A1 Feb. 17, 2011

(30) Foreign Application Priority Data

Aug. 13, 2009 (CN) ..... 2009 1 0305587.6

(51) Int. Cl.
*B22C 3/00* (2006.01)

(52) U.S. Cl. ..... 164/72; 164/472

(58) Field of Classification Search ..... 164/72, 164/472

See application file for complete search history.

(56) References Cited

U.S. PATENT DOCUMENTS 4,167,418 A * 9/1979 Svirsky et al. ..... 106/38.28
5,948,532 A * 9/1999 Hwang et al. ..... 428/408
2009/0166259 A1 * 7/2009 Bradley et al. ..... 208/120.01

* cited by examiner

*Primary Examiner* — Kuang Lin
(74) *Attorney, Agent, or Firm* — Altis Law Group, Inc.

(57) ABSTRACT

A mold, comprising: a substrate, the substrate having an inside surface and an outside surface; and a ceramic coating formed on at least substantially the entire inside surface, the ceramic coating comprising chromic oxide, silicon dioxide, and alumina. A method for making the present mold is provided.

12 Claims, 5 Drawing Sheets

HIGH TEMPERATURE METAL MOLD AND PROCEDURE FOR MAKING THE MOLD

BACKGROUND

1. Technical Field

The present disclosure generally relates to a mold, particularly, to a mold having a ceramic coating for molding metal articles at high temperature and method for making the mold.

2. Description of Related Art

Titanium, magnesium, and aluminum alloys are typically processed to form articles. During the process, a corresponding metallic base alloy is placed into a mold. The mold is heated to a temperature generally higher than 800° C., softening the base alloy. The mold is usually made of metal or ceramic materials. Ceramic molds are good at surface oxidation and corrosion resistance, but have bad shock resistance. Metal molds are strong and shock resistant, but have bad surface oxidation and corrosion resistance. Additionally, at high temperatures, the surfaces of metal molds tend to be oxidized and adhesive.

Therefore, there is room for improvement within the art.

BRIEF DESCRIPTION OF THE DRAWINGS

Many aspects of the mold and method for making the mold can be better understood with reference to the following drawings. The components in the drawings are not necessarily to scale, the emphasis instead being placed upon clearly illustrating the principles of the present mold and method for making the same.

DETAILED DESCRIPTION

Figure 3:
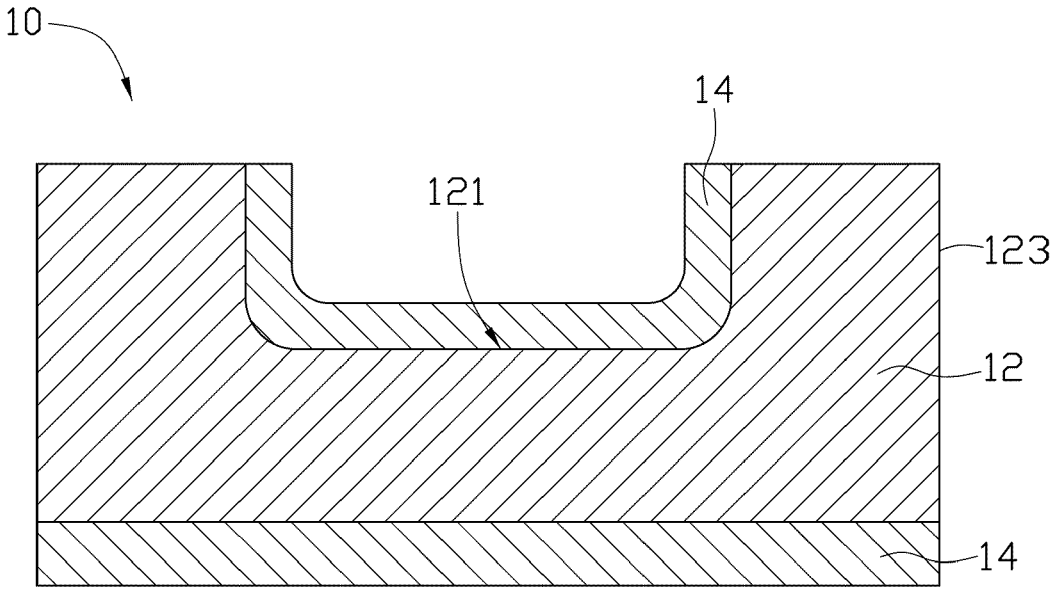
FIG. 3 is a schematic cross-section view of an exemplary embodiment of the present mold.

FIG. 3 shows an exemplary mold 10 for molding metal articles at high temperatures. The molded metal articles include titanium, manganese and aluminum alloys. The mold 10 includes a substrate 12 and a ceramic coating 14.

The substrate 12 is made of metal, such as heat resistant alloy steel. The substrate 12 has an inside surface 121 and an outside surface 123.

The ceramic coating 14 is formed on and covers the inside surface 121 and a bottom portion of the outside surface 123. Thermal spraying, e.g., flame spraying or plasma spraying can be used to form the ceramic coating 14. By weight, the ceramic coating 14 comprises about 89% to 93% chromic oxide ($Cr_2O_3$), about 6% to 10% silicon dioxide ($SiO_2$), and about 0.5% to 1.5% alumina ($Al_2O_3$). In an exemplary embodiment, the amount, by weight, of the chromic oxide, silicon dioxide, and alumina are respectively selected as 91%, 8%, and 1%. The thickness of the ceramic coating can be about 0.05 to 0.15 mm, and in an exemplary embodiment is about 0.10 to 0.12 mm.

An exemplary method for making the mold 10 may include the following steps.

The substrate 12 is provided and pretreated, during which the substrate 12 is degreased using an alkali-based cleaning solution to remove oil stains. The degreased substrate 12 is roughened; for example, by abrasive blasting to achieve an average surface roughness (Ry) of about 40 to 100 μm.

The substrate 12 is preheated to a temperature of about 150 to 200° C. The molten spray material to form the ceramic coating 14 may have a temperature of about 2500° C. The preheating of the substrate 12 ensures good bonding between the substrate 12 and the ceramic coating 14.

A ceramic coating 14 is formed on the substrate 12 by a thermal spraying method, e.g., flame spraying or plasma spraying. A wire material is used in the flame spraying. The flame spraying process is carried out using: a pressure of oxygen flow of about 0.4 to 0.44 MPa, a pressure of acetylene flow of about 0.14 to 0.18 MPa, an air pressure of about 0.45 to 0.5 MPa, a feeding velocity of the wire material of about 0.45 to 0.48 m/min, and a moving speed of the spray gun of about 1000 mm/s The oxygen and the acetylene are the fuel gas. The air is used for deliver the sprayed material.

The present mold 10 having the ceramic coating 14 can be compared with molds not having ceramic coatings, and molds coated with different ceramic coatings, for example a ceramic coating comprising titanium oxide ($TiO_2$) and chromic oxide ($Cr_2O_3$) (hereinafter referred to as the "titanium oxide coating"). The three distinct molds are tested to mold one hundred titanium articles, such as by super-plastic forming or blow molding under a molding temperature of about 800 to 900° C.

Figure 1:
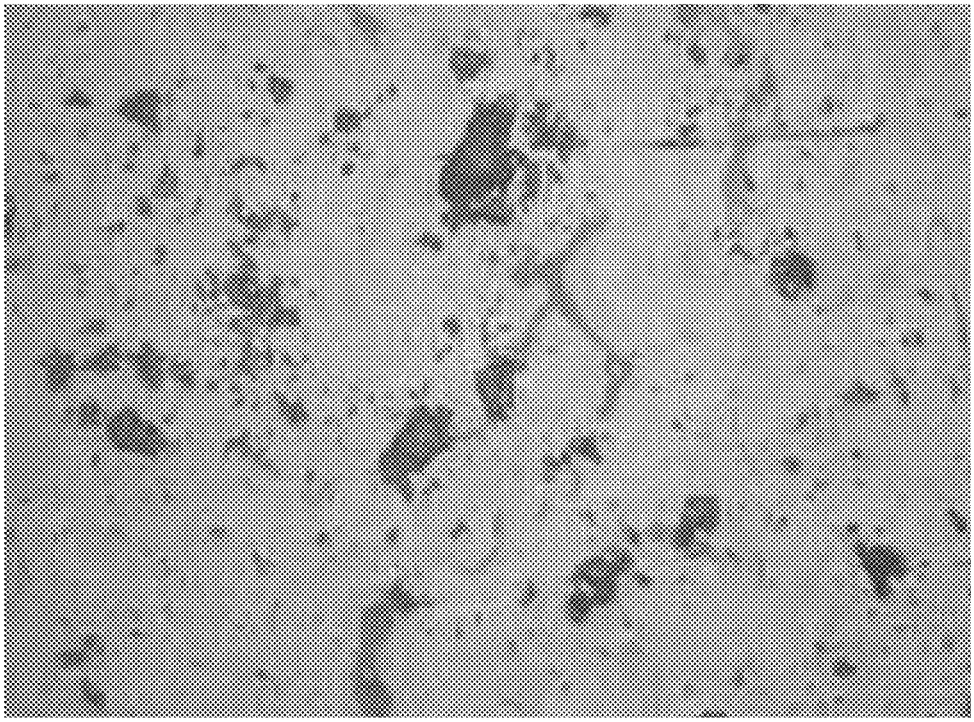
FIG. 1 is a surface view under a metallurgical microscope (100× magnified) of an unused ceramic coating of titanium oxide and chromic oxide.
Figure 2:
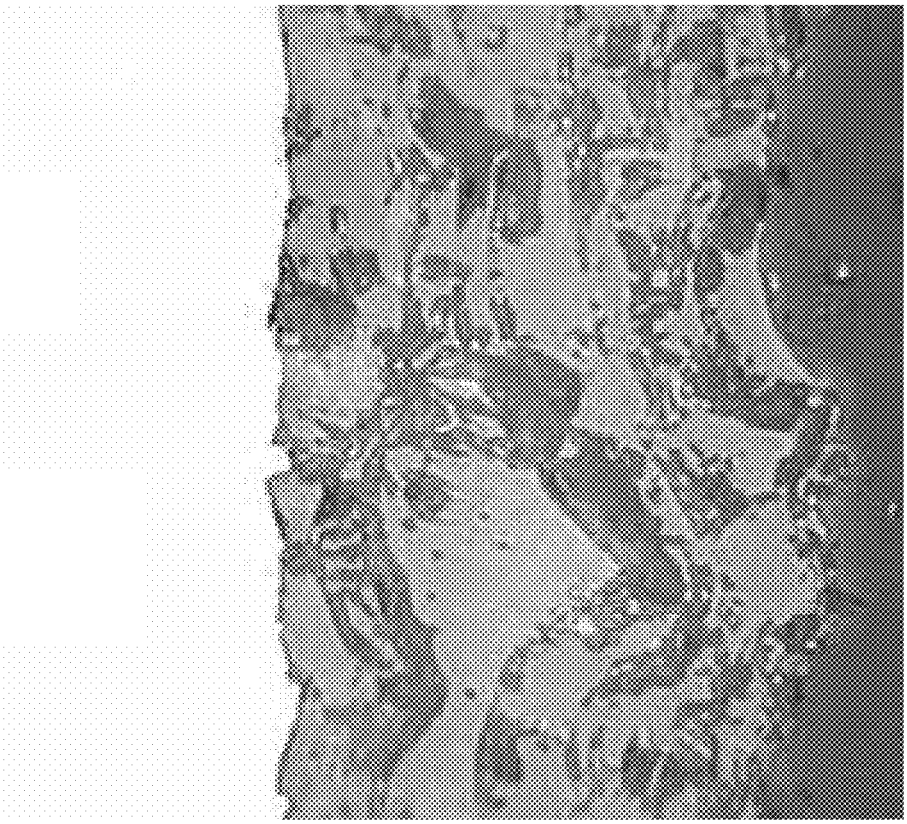
FIG. 2 is a cross-section view under a metallurgical microscope (100× magnified) of the ceramic coating shown in FIG. 1.
Figure 4:
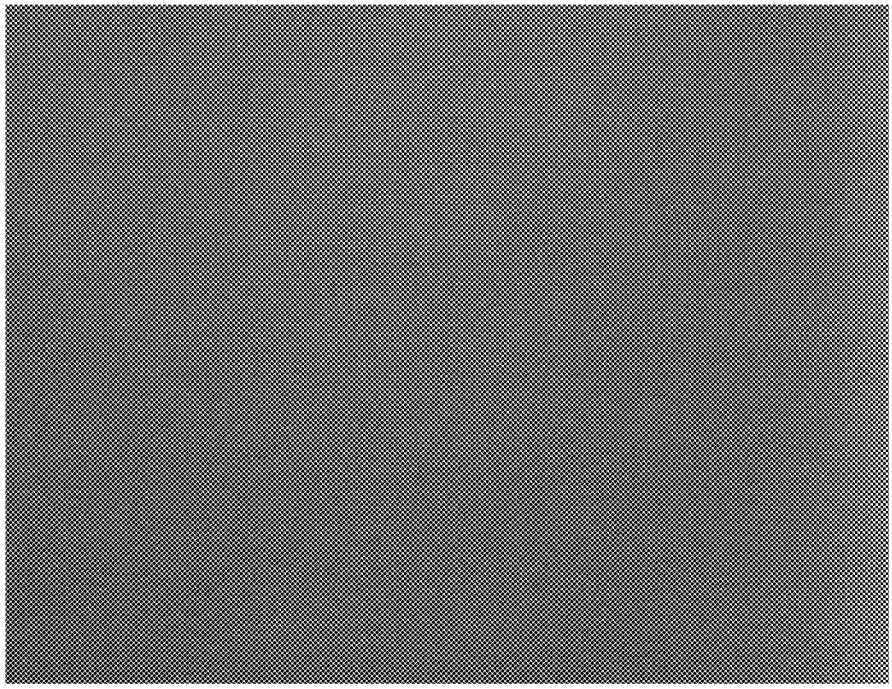
FIG. 4 is a surface view under a metallurgical microscope (100× magnified) of an unused ceramic coating as formed on the mold shown in FIG. 3.
Figure 5:
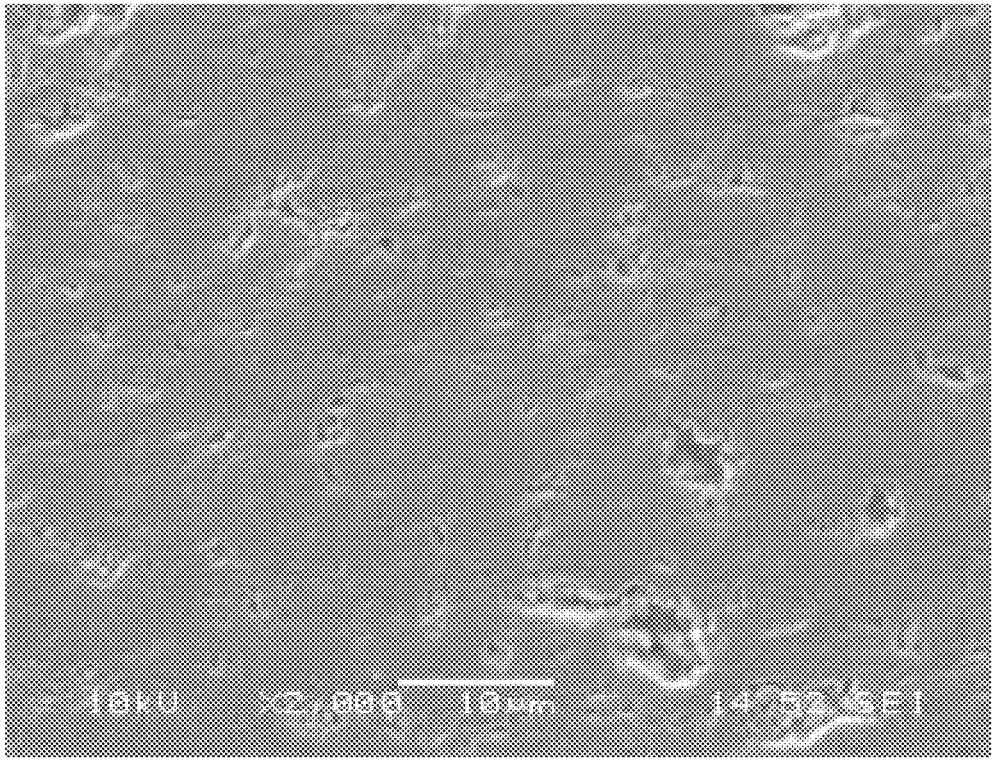
FIG. 5 is a cross-section view under a metallurgical microscope (100× magnified) of the ceramic coating as formed on the mold shown in FIG. 3.

Referring to FIG. 1, the unused titanium oxide coating has an average surface roughness (Ry) of about 10.0 μm or more. Furthermore, FIG. 2 shows that the cross-section of the titanium oxide coating has many pores. The pores have an average aperture size of about 16.4 μm or more. As shown in FIGS. 4 and 5, the ceramic coating 14 of an exemplary embodiment has a smoother surface with an average surface roughness (Ry) of about 1.56 μm or less. The cross-section of the ceramic coating 14 is solid and has less pores, which have an average aperture size less than 5.0 μm.

Results:

a) No Ceramic Coating: After the molding, oxidation to the inside surface of the mold not having any ceramic coatings is obvious. Furthermore, some portions of the oxide film on the inside surface have peeled off.

b) Titanium Oxide Coating: After repeated molding processes, the titanium oxide coating of the titanium oxide coated mold substantially peeled off. Portions of the surface where the titanium oxide coating peeled off are obviously oxidized.

c) Coating according to the Exemplary Embodiment: By contrast, the ceramic coating 14 on the mold 10 has no obvious changes. The articles molded by the mold 10 have very smooth surfaces of even color and glossy luster.

It should be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mold, comprising:

a substrate, the substrate having an inside surface and an outside surface; and a ceramic coating formed on at least substantially the entire inside surface, the ceramic coating comprising chromic oxide, silicon dioxide, and alumina, wherein by weight, the ceramic coating comprises about 89% to 93% chromic oxide, about 6% to 10% silicon dioxide, and about 0.5% to 1.5% alumina.

2. The mold as claimed in claim 1, wherein the amount, by weight, of the chromic oxide, silicon dioxide, and alumina are respectively 91%, 8%, and 1%.

3. The mold as claimed in claim 1, wherein the ceramic coating has a thickness of about 0.05 to 0.15 mm.

4. The mold as claimed in claim 3, wherein the ceramic coating has a thickness of about 0.10 to 0.12 mm.

5. The mold as claimed in claim 1, wherein the ceramic coating has an average surface roughness (Ry) of 1.56 μm or less.

6. The mold as claimed in claim 5, wherein the cross-section of the ceramic coating has pores, wherein the pores have an average aperture size less than 5.0 μm.

7. The mold as claimed in claim 1, wherein the substrate is metal.

8. The mold as claimed in claim 1, wherein the ceramic coating is further formed on a bottom portion of the outside surface of the substrate.

9. A method for making a mold, comprising:

providing a substrate, the substrate having an inside surface and an outside surface;

roughening a surface of the substrate;

preheating the roughened substrate; and thermal spraying a ceramic coating on at least the entire inside surface, the ceramic coating the ceramic coating comprising chromic oxide, silicon dioxide, and alumina, wherein by weight, the ceramic coating comprises about 89% to 93% chromic oxide, about 6% to 10% silicon dioxide, and about 0.5% to 1.5% alumina.

10. The method as claimed in claim 9, wherein the ceramic coating is formed by flame spraying using wire material.

11. The method as claimed in claim 9, wherein the ceramic coating has a thickness of about 0.05 to 0.15 mm.

12. The method as claimed in claim 9, wherein the roughened substrate has an average surface roughness (Ry) of about 40 to 100 μm.

* * * * *